US006911949B2

(12) United States Patent
Naym et al.

(10) Patent No.: US 6,911,949 B2
(45) Date of Patent: Jun. 28, 2005

(54) ANTENNA STABILIZATION SYSTEM FOR TWO ANTENNAS

(75) Inventors: Guy Naym, Netanya (IL); Nathan A. Levy, Raanana (IL)

(73) Assignee: Orbit Communication Ltd., Netanya (IL)

( * ) Notice: Subject to any disclaimer, the term of this patent is extended or adjusted under 35 U.S.C. 154(b) by 74 days.

(21) Appl. No.: 10/687,093

(22) Filed: Oct. 17, 2003

(65) Prior Publication Data

US 2004/0135735 A1 Jul. 15, 2004

Related U.S. Application Data

(60) Provisional application No. 60/419,543, filed on Oct. 21, 2002.

(51) Int. Cl.[7] ..... H01A 3/00
(52) U.S. Cl. ..... 343/765
(58) Field of Search ..... 343/765, 882, 343/766, 878, 890, 891, 892

(56) References Cited

U.S. PATENT DOCUMENTS 5,859,612 A * 1/1999 Gilhousen ..... 342/457
6,034,635 A * 3/2000 Gilhousen ..... 342/457
6,043,788 A * 3/2000 Seavey ..... 343/781 CA
6,195,046 B1 * 2/2001 Gilhousen ..... 342/457
6,243,046 B1 6/2001 Aoki ..... 343/765
6,310,582 B1 10/2001 Uetake et al. ..... 343/765
6,441,800 B1 8/2002 Chan et al. ..... 343/879
6,710,749 B2 * 3/2004 King ..... 343/765

FOREIGN PATENT DOCUMENTS

EP 1365472 11/2003
WO WO02/071537 9/2002

* cited by examiner

*Primary Examiner*—Don Wong
*Assistant Examiner*—Huedung X. Cao
(74) *Attorney, Agent, or Firm*—Mark M. Friedman

(57) ABSTRACT

A system for stabilizing two antennas on a mobile platform, the antennas including a first antenna associated with a first geo-stationary satellite and a second antenna associated with a second geo-stationary satellite, the system comprising an upper alignment system and a lower alignment system. The upper alignment system is configured for being a common support for the antennas. The upper alignment system has an intermediate element. The upper alignment system is configured for pointing the antennas relative to the intermediate element, such that the angular displacement between the antennas is matched with the angular displacement between the satellites. The lower alignment system is connected to the upper alignment system and the mobile platform. The lower alignment system is configured for maintaining the orientation of the intermediate element in order to compensate for rotation of the mobile platform, such that the antennas are maintained pointing toward their respective satellites.

14 Claims, 3 Drawing Sheets

ANTENNA STABILIZATION SYSTEM FOR TWO ANTENNAS

This application claims priority from U.S. Provisional Application No. 60/419,543 filed on 21st Oct. 2002.

FIELD AND BACKGROUND OF THE INVENTION

The present invention relates to antennas of geo-stationary satellites and, in particular, it concerns stabilizing two antennas mounted on a single pedestal.

By way of introduction, various geo-stationary satellites are located at approximately 36,000 Km from the surface of the earth around the equator in a belt known as the "Clark Belt". These satellites serve satellite TV channels and two way communication such as internet, data video conferencing and voice communications. However, not all the TV channels are available from the communication satellites. For example, in the U.S.A. the communication satellites (FSS) which are located at 91 degrees West, 99 Degrees West and 116.8 degrees West do not include the Broadcast TV channels which are provided by the BSS satellites at 101 degrees West, 110 degrees West and 119 degrees West. Typically, on a mobile platform, for example, but not limited to a marine, airborne or ground mobile platform, there is a need to provide both two way communication and to receive broadcast TV channels. Therefore, there is a need to mount two antennas on the mobile platform in order to provide simultaneous links with two satellites, one for TV Receive Only communications (TVRO) and the other for two way (Tx/Rx) communication.

The simple and common solution is to use two separate pedestal/tracking antenna systems. This solution requires a large amount of space, is not cost effective and there may be interference between the two antennas if they are placed to close together. In addition, two radomes or one large radome are required which takes up additional space and is very expensive.

It is known in the field of antenna alignment to use a single antenna with multiple feeds, such that the antenna receives signals from a plurality of satellites. However, the Regulatory authorities, such as the FCC and ETSI require that the end-user terminal be aligned very accurately with a satellite in order for the end-user to transmit to the satellite. The alignment accuracy required by the Regulatory authorities cannot be achieved using a multiple feed system.

It is also known in the field of antenna alignment systems to mount two antennas on a single pedestal for tracking low earth orbit (LEO) satellites. An example of such a system is taught by U.S. Pat. No. 6,310,582 to Uetake, et al. The aforementioned system is suitable for LEO satellites, but is not suitable for tracking two geo-stationary satellites.

There is therefore a need for a cost and space effective stabilization system for two antennas associated with geo-stationary satellites where at least one of the antennas is linearly polarized.

SUMMARY OF THE INVENTION

The present invention is an antenna stabilization system construction and method of operation thereof.

According to the teachings of the present invention there is provided, a system for stabilizing at least two antennas on a mobile platform, the antennas including a first antenna associated with a first geo-stationary satellite and a second antenna associated with a second geo-stationary satellite, the system comprising: (a) an upper alignment system configured for being a common support for the antennas, the upper alignment system having at least one degree of freedom, the upper alignment system including an intermediate element, the upper alignment system being configured for pointing the antennas relative to the intermediate element, such that the angular displacement between the first antenna and the second antenna is substantially matched with the angular displacement between the first geo-stationary satellite and the second geo-stationary satellite; and (b) a lower alignment system mechanically connected to the upper alignment system and the mobile platform, the lower alignment system having three degrees of freedom, the lower alignment system being configured for maintaining the orientation of the intermediate element in order to compensate for rotation of the mobile platform, such that the first antenna and the second antenna are maintained pointing toward the first geo-stationary satellite and the second geo-stationary satellite, respectively.

According to a further feature of the present invention, the three degrees of freedom are rotational degrees of freedom, the three degrees of freedom including roll, pitch and yaw, the lower alignment system being configured for maintaining the orientation of the intermediate element in order to compensate for movements of yaw, pitch and roll of the mobile platform.

According to a further feature of the present invention, the upper alignment system and the lower alignment system are configured, such that the lower alignment system maintains the orientation of the intermediate element in order that movement of the first antenna and the second antenna is substantially restricted to pointing to satellite of the Clark belt.

According to a further feature of the present invention, the upper alignment system is configured, such that the polarization of the first antenna is adjustable.

According to a further feature of the present invention, the upper alignment system is configured, such that the polarization of the second antenna is adjustable.

According to a further feature of the present invention, the one degree of freedom of the upper alignment system is a rotational degree of freedom configured for setting the cross-elevation of the first antenna and the second antenna.

According to a further feature of the present invention, the upper alignment system, the lower alignment system, the first antenna and the second antenna fit under a single radome.

According to a further feature of the present invention, the upper alignment system and the lower alignment system are configured to provide full hemispherical coverage for the first antenna and the second antenna.

According to the teachings of the present invention there is also provided a method for stabilizing at least two antennas on a mobile platform, the antennas including a first antenna associated with a first geo stationery satellite and a second antenna associated with a second geo stationery satellite, the method comprising the steps of: (a) mechanically connecting the antennas to an element; (b) pointing the antennas relative to each other such that the angular displacement between the first antenna and the second antenna is matched with the angular displacement between the first geo-stationary satellite and the geo-stationary second satellite; and (c) maintaining the orientation of the element in order to compensate for rotation of the mobile platform, such that the first antenna and the second antenna are maintained pointing toward the first geo-stationary satellite and the second geo-stationary satellite, respectively.

According to a further feature of the present invention, the step of maintaining includes at least one of a roll adjustment, a pitch adjustment and a yaw adjustment in order to compensate for movements of roll, pitch and yaw of the mobile platform, respectively.

According to a further feature of the present invention, the step of maintaining is performed, such that movement of the first antenna and the second antenna is restricted to pointing to satellite of the Clark belt.

According to a further feature of the present invention, there is also provided the step of adjusting the polarization of the first antenna.

According to a further feature of the present invention, there is also provided the step of adjusting the polarization of the second antenna.

According to a further feature of the present invention, there is also provided the step of disposing the antennas in a single radome.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an antenna stabilization system construction and method of operation thereof.

The principles and operation of an antenna stabilization system according to the present invention may be better understood with reference to the drawings and the accompanying description.

Figure 1:
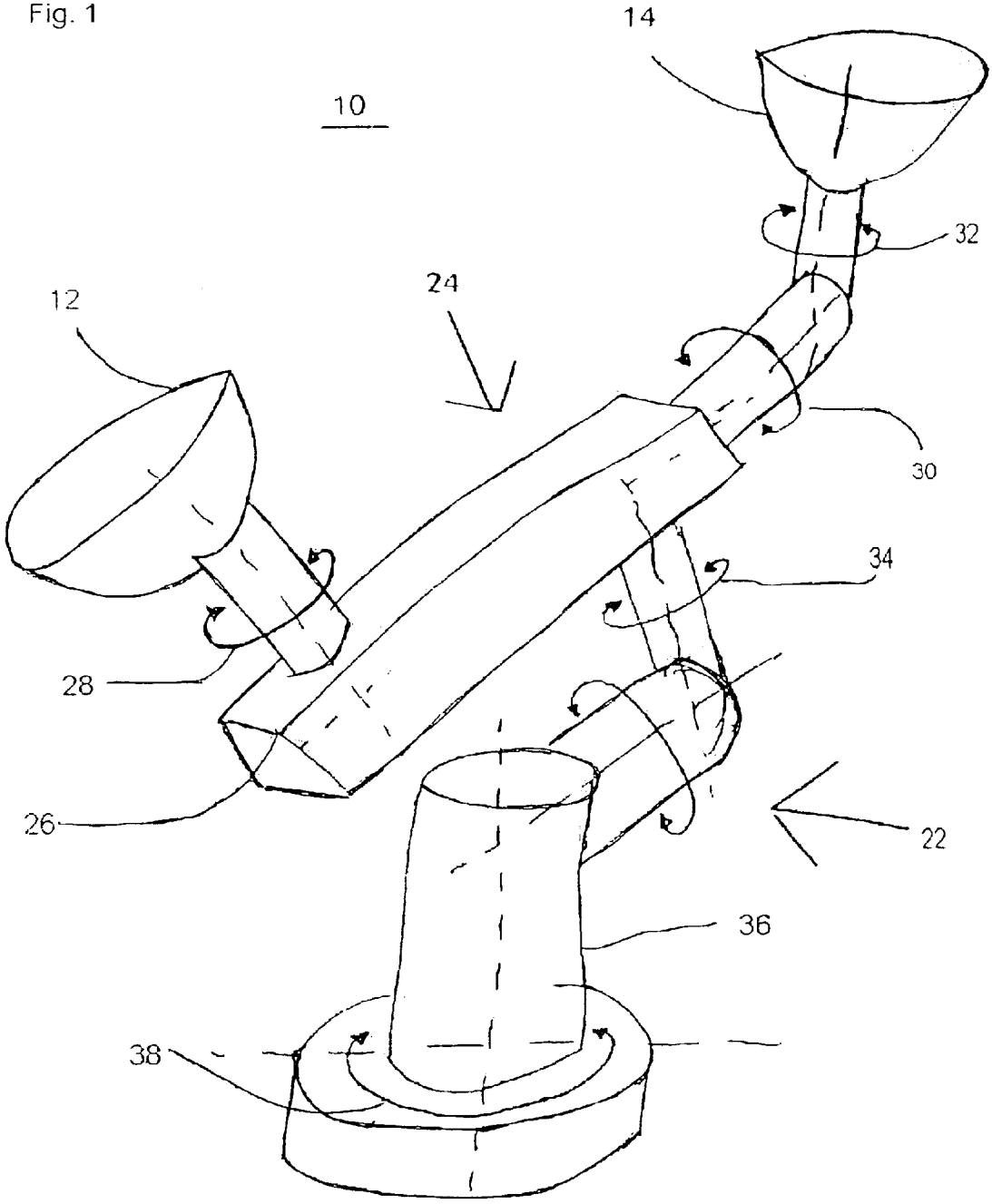
FIG. 1 is a schematic isometric view of an antenna stabilization system that is constructed and operable in accordance with a preferred embodiment of the present invention.
Figure 2:
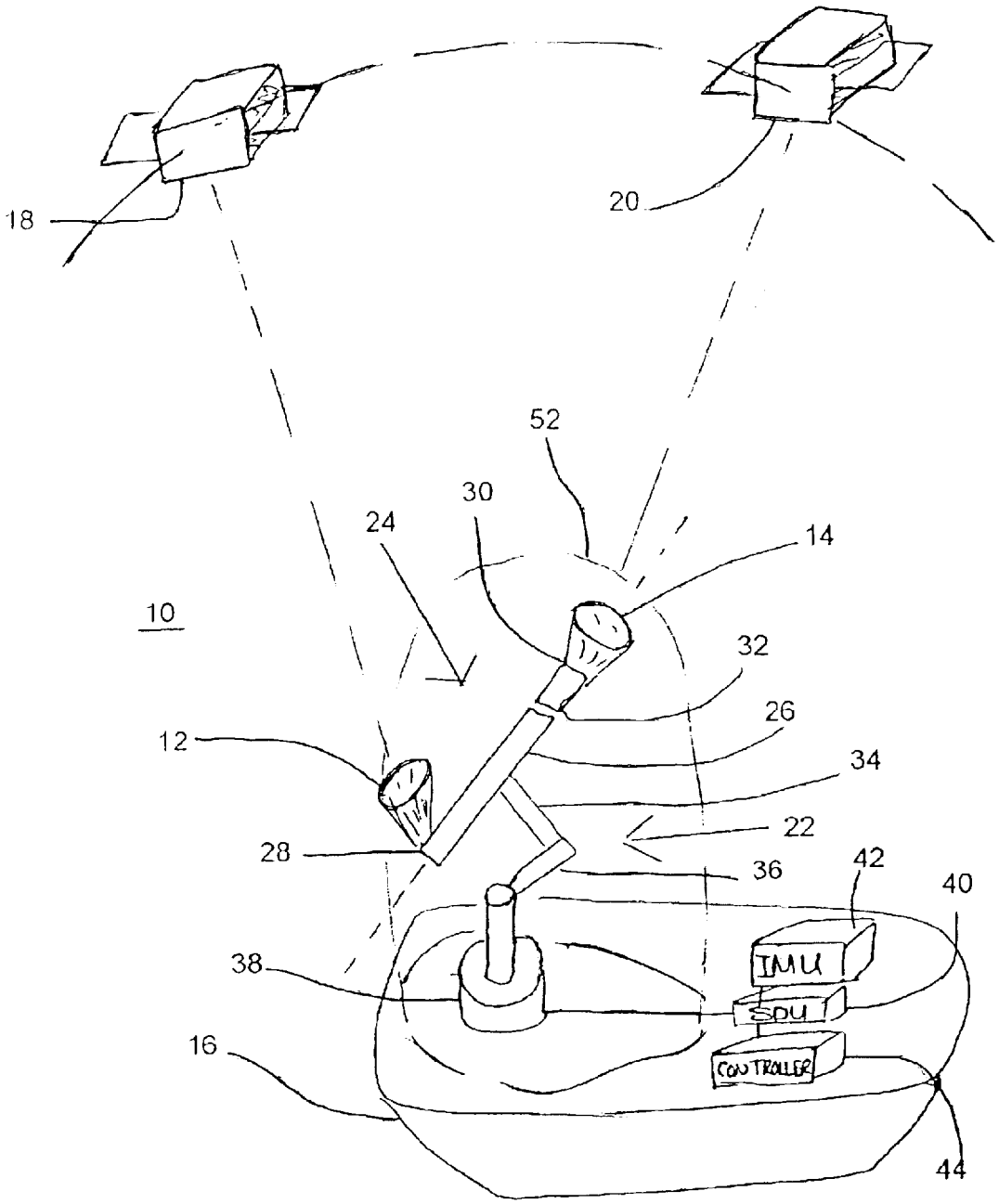
FIG. 2 is a schematic view of the system of FIG. 1 mounted on a mobile platform.

Reference is now made to FIGS. 1 and 2. FIG. 1 is a schematic isometric view of an antenna stabilization system 10 that is constructed and operable in accordance with a preferred embodiment of the present invention. FIG. 2 is a schematic view of antenna stabilization system 10 mounted on a mobile platform 16. Antenna stabilization system 10 is a system for stabilizing two antennas 12, 14 on a mobile platform 16. Antenna 12 is associated with a geo-stationary satellite 18. Antenna 14 is associated with a geo-stationary satellite 20. Antenna stabilization system 10 includes a lower alignment system 22 and an upper alignment system 24. Lower alignment system 22 is mechanically connected to mobile platform 16. Lower alignment system 22 includes an intermediate element 26. Intermediate element 26 is generally an elongated element. Lower alignment system 22 is mechanically connected to upper alignment system 24 via intermediate element 26. Intermediate element 26 of upper alignment system 24 is a common support for antenna 12 and antenna 14.

Lower alignment system 22 has three rotational degrees of freedom including a roll adjustment 34, a pitch adjustment 36 and a yaw adjustment 38 for adjusting the orientation of intermediate element 26, as described in more detail below.

Upper alignment system 24 has three rotational degree of freedom 28 30 32. Antenna 12 is mechanically connected to one end of intermediate element 26 via degree of freedom 28. Antenna 14 is mechanically connected to one end of intermediate element 26 via degree of freedom 30 and degree of freedom 32. The axis of rotation of degree of freedom 28 and degree of freedom 30 are perpendicular to the direction of elongation of intermediate element 26. The axis of rotation of degree of freedom 32 is parallel to the direction of elongation of intermediate element 26. Degree of freedom 28 and degree of freedom 30 are configured for adjusting the polarization of antenna 12 and antenna 14, respectively. If antenna 12 and/or antenna 14 are not linearly polarized, then degree of freedom 28 and degree of freedom 30 are not needed, respectively, for example, but not limited to when antenna satellite 20 is a TVRO satellite, degree of freedom 30 is generally not needed.

Lower alignment system 22 and upper alignment system 24 include motors (not shown) for adjusting the degrees of freedom of antenna stabilization system 10. The motors are driven by a servo driver unit 40 (SDU) motor driver.

The operation of antenna stabilization system 10 is best described by first assuming that mobile platform 16 is completely stationary without tilting, rocking, or turning. In this scenario, lower alignment system 22 is configured by adjusting roll adjustment 34, pitch adjustment 36 and yaw adjustment 38, such that the direction of elongation of intermediate element 26 is perpendicular to a plane which includes all the satellites in the Clark Belt and antenna 12 is pointing toward satellite 18. Therefore, as degree of freedom 32 is parallel to the direction of elongation of intermediate element 26, the movement of antenna 14 is restricted, such that antenna 14 is only able to point to satellites in the Clark belt. Degree of freedom 32 is adjusted, such that antenna 14 points toward satellite 20. In other words, degree of freedom 32 substantially matches the angular displacement between antenna 12 and antenna 14 with the angular displacement between the satellite 18 and satellite 20. The term "substantially matches" is defined herein such that the angular displacement is matched well enough, such that antenna 12 can communicate with satellite 18 and antenna 14 can communicate with satellite 20. The angular displacement between satellite 18 and satellite 20 is defined as the angle between two lines, the first line connecting satellite 18 and a point on antenna stabilization system 10, the second line connecting satellite 20 and the same point of antenna stabilization system 10. The angular displacement between antenna 12 and antenna 14 is defined as the angle between a "line of sight" of antenna 12 and a "line of sight" of antenna 14. The term "line of sight" is defined herein as a line joining the communication center of an antenna and the communication center of a satellite, the antenna and the satellite being aligned for peak communication. In other words, degree of freedom 32 is configured for setting the cross-elevation of antenna 12 and antenna 14.

The operation of antenna stabilization system 10 is now described by assuming that mobile platform 16 is rotating. Rotating is defined herein as to include tilting, rocking, or turning of mobile platform 16. Antenna stabilization system 10 also includes an inertial measurement unit 42 (IMU) for measuring movement of mobile platform 16. Antenna stabilization system 10 also includes a controller 44. Controller 44 is configured for processing the measurements of inertial measurement unit 42 as well as running algorithms for continuous peak signal-strength detection. Therefore, measurements from inertial measurement unit 42 provide data for coarse adjustment of lower alignment system 22 and upper alignment system 24, while signal-strength algorithms provide data for fine adjustment of lower alignment system 22 and upper alignment system 24. Therefore, the signal strength algorithms enable the accuracy and therefore the cost of inertial measurement unit 42, lower alignment system 22 and upper alignment system 24 to be reduced. U.S. Pat. No. 6,608,950 to Naym, et al. describes a novel system for adjusting for polarization using auto-correlation. It will be appreciated by those ordinarily skilled in the art that the auto-correlation method can be used for aligning roll of antenna stabilization system 10. Methods for adjusting yaw and pitch using signal strength techniques are known by those skilled in the art. Controller 44 is configured for instructing servo driver unit 40 to adjust the motors of lower alignment system 22 and upper alignment system 24 in order to adjust for movements of mobile platform 16. Therefore, lower alignment system 22 is configured for maintaining the orientation of intermediate element 26 in order to compensate for rotation of mobile platform 16 relative to satellite 18 and satellite 20, such that the direction of elongation of intermediate element 26 is perpendicular to a plane which includes all the satellites in the Clark Belt and antenna 12 is pointing toward satellite 18. In other words, lower alignment system 22 is configured for maintaining intermediate element 26 in a constant angular and rotational position. The angular displacement between antenna 12 and antenna 14 does not need to be adjusted by adjusting degree of freedom 32. This is because the angular displacement between satellite 18 and satellite 20 does not alter significantly enough to effect communication between antennas 12, 14 and satellites 18, 20, respectively. The angular displacement between antenna 12 and antenna 14 only needs to be adjusted when there is a significant change in longitude or latitude of mobile platform 16, which effects communication.

Therefore, adjustment of at least one of roll adjustment 34, pitch adjustment 36 and yaw adjustment 38 of lower alignment system 22 is enough to compensate for at least one of roll, pitch and yaw movement of mobile platform 16 relative to satellites 18, 20, such that antenna 12 and antenna 14 are maintained pointing toward satellite 18 and satellite 20, respectively, without needing to adjust upper alignment system 24. Therefore, one of the important advantages of antenna stabilization system 10 is that only the degrees of freedom of lower alignment system 22 need to be adjusted to realign both antenna 12 and antenna 14 toward satellite 18 and satellite 20, respectively. Therefore, degree of freedom 28, degree of freedom 30 and degree of freedom 32 of upper alignment system 24 only need to have a low-dynamic response, for example, for selecting a different pair of satellites or for accurate correction and/or compensation of slight variations of the angular displacement of satellite 18 and satellite 20 due to geographical longitudinal or latitudinal movement of mobile platform 16. Roll adjustment 34, pitch adjustment 36 and yaw adjustment 38 of lower alignment system 22 need to have a high dynamic response, typically having a velocity up to 30 degrees per second, and an acceleration of up to 30 degrees per second per second. Antenna stabilization system 10 typically has a pointing accuracy better than 0.3 degrees RMS. Additionally, antenna stabilization system 10 typically has a resolution of less than 0.01 degree, enabling very smooth operation and high quality continuous step-track.

The rotational requirement of the degrees of freedom of antenna stabilization system 10 are typically as follows. Yaw adjustment 38 is continuous. Pitch adjustment 36 is from minus 10 degrees to plus 90 degrees. Roll adjustment 34 is from minus 60 degrees to plus 60 degrees. Degree of freedom 28 and degree of freedom 30 are both from minus 90 degrees to plus 90 degrees. Degree of freedom 32 is from minus 90 degrees to plus 90 degrees.

The system and method of the present invention also includes the following advantages. First, antenna stabilization system 10 enables selection of any pair of satellites. Second, antenna stabilization system 10 enables antenna 12 and antenna 14 to be pointed toward a single satellite or two very close satellites. Third, antenna stabilization system 10 including antenna 12 and antenna 14 fits under a single radome 52. Fourth, there is no communication blockage between antenna 12 and antenna 14. Fifth, the lower alignment system 22 and upper alignment system 24 are configured to provide full hemispherical coverage for the antenna 12 and antenna 14, typically down to minus 10 degrees elevation (pitch) and continuous azimuth (yaw) rotation.

Figure 3:
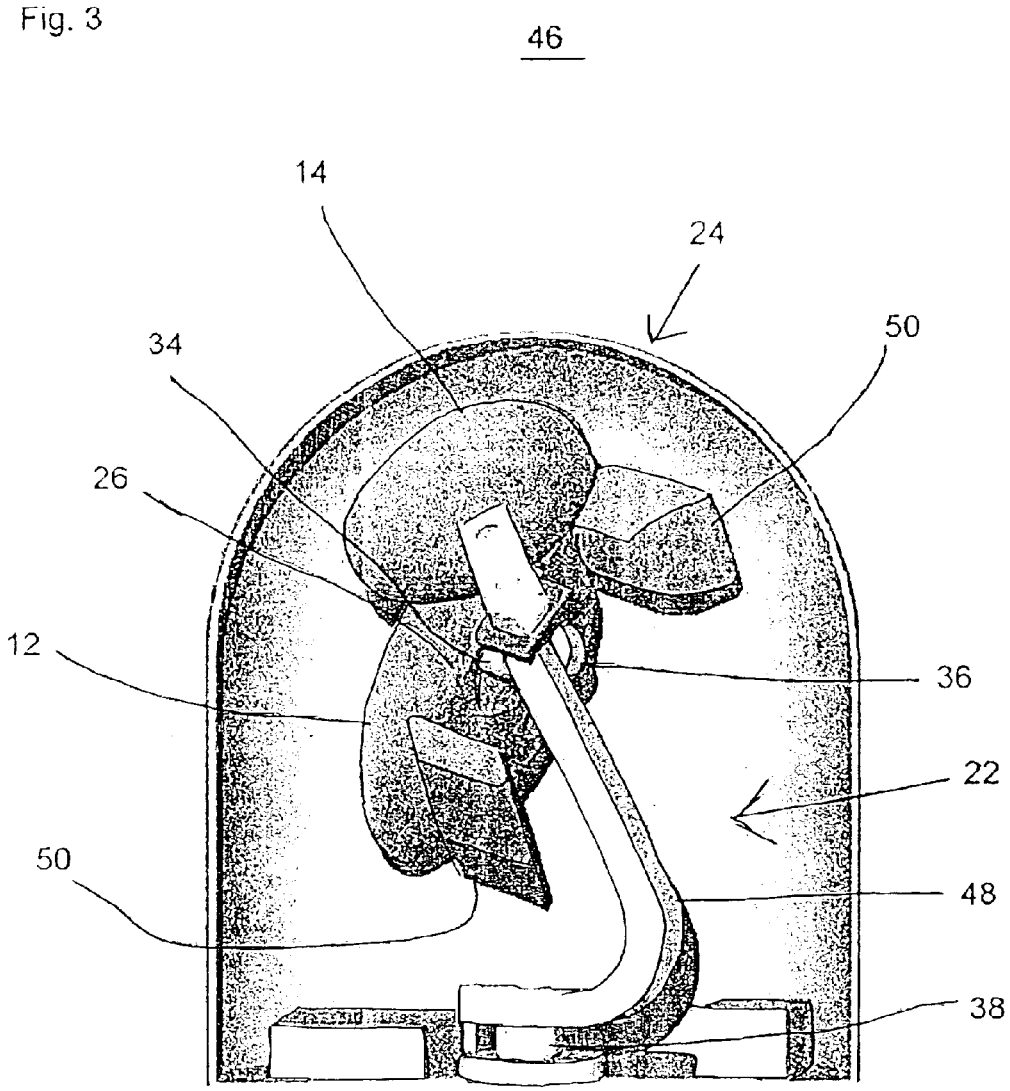
FIG. 3 is an isometric view of an antenna stabilization system that is constructed and operable in accordance with a most preferred embodiment of the present invention.

Reference is now made to FIG. 3, which is an isometric view of an antenna stabilization system 46 that is constructed and operable in accordance with a most preferred embodiment of the present invention. Antenna stabilization system 46 is the same as antenna stabilization system 10 (FIG. 1) except for the following differences. Pitch adjustment 36 and roll adjustment 34 are both disposed very close to intermediate element 26. Therefore, lower alignment system 22 has a curved elongated element 48 disposed between pitch adjustment 36 and yaw adjustment 38 in order that movement of antennas 12, 14 is not restricted, such that antenna stabilization system 10 provides full hemispherical coverage for antenna 12 and antenna 14. Additionally, upper alignment system 24 includes a counterweight arrangement 50 disposed on intermediate element 26 in order to reduce the load on the motors (not shown) of antenna stabilization system 46.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art which would occur to persons skilled in the art upon reading the foregoing description.

What is claimed is:

1. A system for stabilizing at least two antennas on a mobile platform, the antennas including a first antenna associated with a first geo-stationary satellite and a second antenna associated with a second geo-stationary satellite, the system comprising:

(a) an upper alignment system configured for being a common support for the antennas, said upper alignment system having at least one degree of freedom, said upper alignment system including an intermediate element, said upper alignment system being configured for pointing the antennas relative to said intermediate element, such that the angular displacement between the first antenna and the second antenna is substantially matched with the angular displacement between the first geo-stationary satellite and the second geo-stationary satellite; and (b) a lower alignment system mechanically connected to said upper alignment system and the mobile platform, said lower alignment system having three degrees of freedom, said lower alignment system being configured for maintaining the orientation of said intermediate element in order to compensate for rotation of the mobile platform, such that the first antenna and the second antenna are maintained pointing toward the first geo-stationary satellite and the second geo-stationary satellite, respectively.

2. The system of claim 1, wherein said three degrees of freedom are rotational degrees of freedom, said three degrees of freedom including roll, pitch and yaw, said lower alignment system being configured for maintaining the orientation of said intermediate element in order to compensate for movements of yaw, pitch and roll of the mobile platform.

3. The system of claim 1, wherein said upper alignment system and said lower alignment system are configured, such that said lower alignment system maintains the orientation of said intermediate element in order that movement of the first antenna and the second antenna is substantially restricted to pointing to satellite of the Clark belt.

4. The system of claim 1, wherein said upper alignment system is configured, such that the polarization of the first antenna is adjustable.

5. The system of claim 4, wherein said upper alignment system is configured, such that the polarization of the second antenna is adjustable.

6. The system of claim 1, wherein said one degree of freedom of said upper alignment system is a rotational degree of freedom configured for setting the cross-elevation of the first antenna and the second antenna.

7. The system of claim 1, wherein said upper alignment system, said lower alignment system, the first antenna and the second antenna fit under a single radome.

8. The system of claim 1, wherein said upper alignment system and said lower alignment system are configured to provide full hemispherical coverage for the first antenna and the second antenna.

9. A method for stabilizing at least two antennas on a mobile platform, the antennas including a first antenna associated with a first geo stationery satellite and a second antenna associated with a second geo stationery satellite, the method comprising the steps of:

(a) mechanically connecting the antennas to an element;

(b) pointing the antennas relative to each other such that the angular displacement between the first antenna and the second antenna is matched with the angular displacement between the first geo-stationary satellite and the geo-stationary second satellite; and (c) maintaining the orientation of said element in order to compensate for rotation of the mobile platform, such that the first antenna and the second antenna are maintained pointing toward the first geo-stationary satellite and the second geo-stationary satellite, respectively.

10. The method of claim 9, wherein said step of maintaining includes at least one of a roll adjustment, a pitch adjustment and a yaw adjustment in order to compensate for movements of roll, pitch and yaw of the mobile platform, respectively.

11. The method of claim 9, wherein said step of maintaining is performed, such that movement of the first antenna and the second antenna is restricted to pointing to satellite of the Clark belt.

12. The method of claim 9, further comprising the step of adjusting the polarization of the first antenna.

13. The system of claim 12, further comprising the step of adjusting the polarization of the second antenna.

14. The system of claim 9, further comprising the step of disposing the antennas in a single radome.

* * * * *